US006651626B2

(12) United States Patent
Rodriguez-Amaya et al.

(10) Patent No.: US 6,651,626 B2
(45) Date of Patent: Nov. 25, 2003

(54) FUEL INJECTION APPARATUS FOR INTERNAL COMBUSTION ENGINES

(75) Inventors: Nestor Rodriguez-Amaya, Stuttgart (DE); Roger Potschin, Brackenheim (DE); Juergen Gruen, Ditzingen (DE); Ulrich Projahn, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 46 days.

(21) Appl. No.: 10/097,429

(22) Filed: Mar. 15, 2002

(65) Prior Publication Data

US 2002/0129792 A1 Sep. 19, 2002

(30) Foreign Application Priority Data

Mar. 15, 2001 (DE) ..... 101 12 432

(51) Int. Cl.[7] ..... F02M 37/04
(52) U.S. Cl. ..... 123/447; 123/446
(58) Field of Search ..... 123/446, 447, 123/467

(56) References Cited

U.S. PATENT DOCUMENTS 5,642,714 A * 7/1997 Buckley ..... 123/447
5,727,525 A * 3/1998 Tsuzuki ..... 123/447
5,732,679 A * 3/1998 Takahasi et al. ..... 123/467
6,092,509 A * 7/2000 Tanabe et al. ..... 123/447
6,363,914 B1 * 4/2002 Tanabe et al. ..... 123/447
6,457,453 B1 * 10/2002 Tanabe et al. ..... 123/447
6,499,465 B1 * 12/2002 Mahr ..... 123/447
2002/0002964 A1 * 1/2002 Kohketsu et al. ..... 123/447

* cited by examiner

*Primary Examiner*—Thomas N. Moulis
(74) *Attorney, Agent, or Firm*—Ronald E. Greigg

(57) ABSTRACT

The fuel injection apparatus for internal combustion engines has one fuel pump for each cylinder of the engine, which pump has a pump piston, driven by the engine in a reciprocating motion, that defines a pump work chamber to which fuel is delivered from a fuel tank and which communicates with a fuel injection valve that has an injection valve member by which at least one injection opening is controlled and which is movable in an opening direction counter to a closing force by the pressure generated in the pump work chamber, by means of a first electrically controlled control valve, a communication of the pump work chamber with a diversion chamber is controlled, and by means of a second electrically controlled control valve, the pressure prevailing in a control pressure chamber of the fuel injection valve is controlled, by which the injection valve member is urged at least indirectly in the closing direction. The diversion chamber is a pressure reservoir, in which an elevated pressure, compared to the pressure prevailing in the fuel tank, is maintained.

20 Claims, 5 Drawing Sheets

FUEL INJECTION APPARATUS FOR INTERNAL COMBUSTION ENGINES

BACKGROUND OF THE INVENTION

1. Field of the Invention

The invention is based on a fuel injection apparatus for internal combustion engines having a fuel pump for each cylinder of the engine.

2. Description of the Prior Art

One fuel injection apparatus, known from European Patent Disclosure EP 0 957 261, has one fuel pump for each cylinder of the engine, which pump has a pump piston, driven by the engine in a reciprocating motion, that defines a pump work chamber to which fuel is delivered from a fuel tank. The pump work chamber communicates with a fuel injection valve, which has an injection valve member by which at least one injection opening is controlled and which is movable in the opening direction counter to a closing force by the pressure prevailing in the pump work chamber. A first electrically controlled control valve is provided, by which a communication of the pump work chamber with the fuel tank, as a diversion chamber, is controlled. A second electrically controlled control valve is also provided, by which the control pressure prevailing in a control pressure chamber is controlled, by means of which pressure the injection valve member is urged at least indirectly in the closing direction. A disadvantage of this known fuel injection apparatus is that because of the use of the pressureless fuel tank as a diversion chamber, the pressure in the pump work chamber and in the regions of the fuel injection apparatus communicating with it drops sharply upon the communication with a relief chamber, with the attendant risk of cavitation. Moreover, as a result the efficiency of the fuel injection apparatus is not optimal.

OBJECTS AND SUMMARY OF THE INVENTION

The fuel injection apparatus of the invention has the advantage over the prior art that because the pressure reservoir, in which an elevated pressure is maintained compared to the fuel tank, is used as a diversion chamber the risk of cavitation is reduced and moreover the efficiency is improved. In addition, pressure fluctuations in the fuel injection apparatus can be damped by the pressure reservoir.

One embodiment of the invention makes it possible to adjust the pressure in the pressure reservoir, for instance as a function of engine operating parameters.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
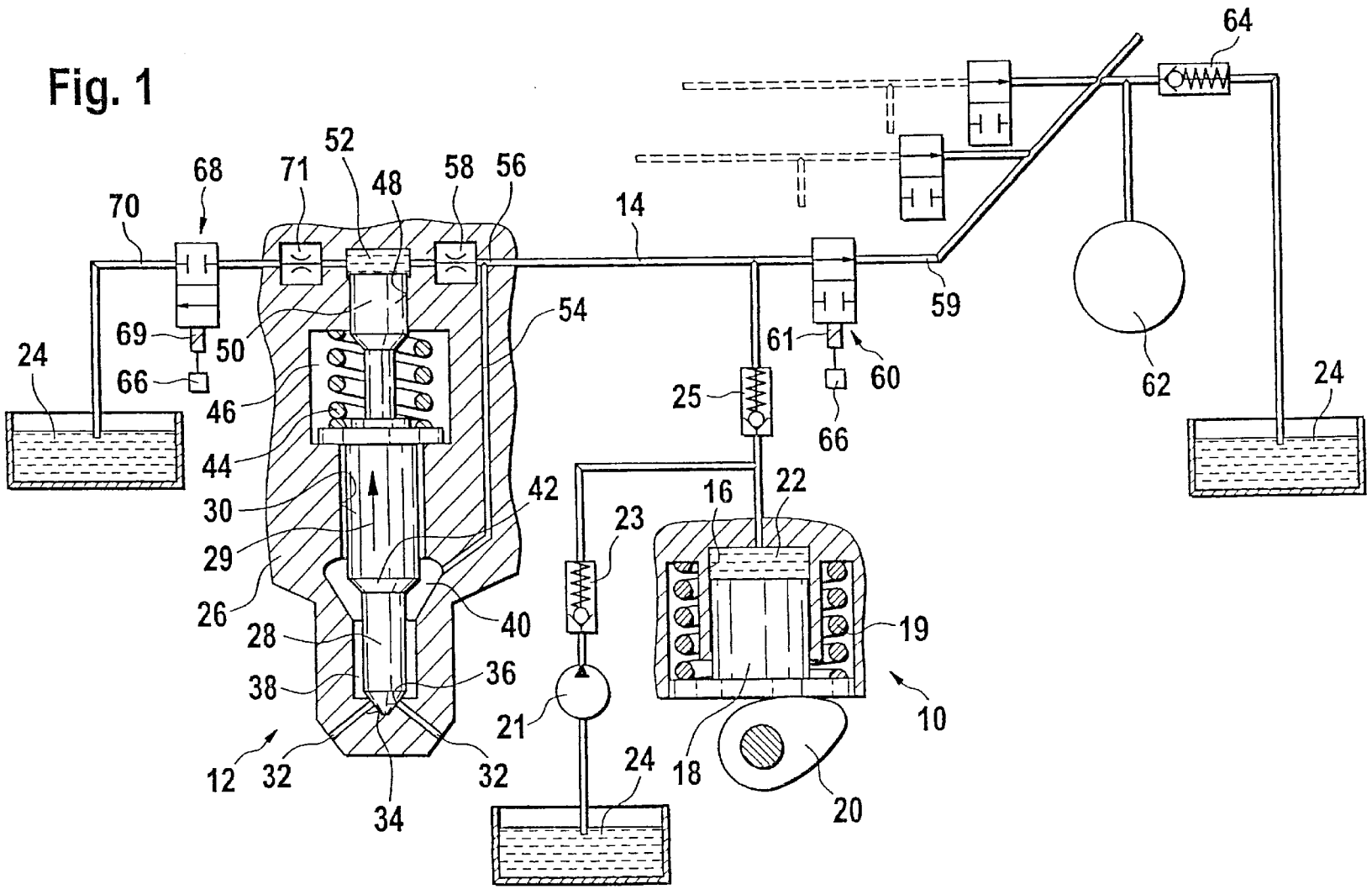
FIG. 1 shows a fuel injection apparatus for an internal combustion engine schematically in a first exemplary embodiment.

FIGS. 1, 2, 4 and 5 show a fuel injection apparatus for an internal combustion engine of a motor vehicle. The engine is preferably a self-igniting internal combustion engine. The fuel injection apparatus is preferably embodied as a so-called pump-line-nozzle system and for each of the engine has one fuel pump 10, one fuel injection valve 12, and one line 14 connecting the fuel injection valve 12 to the fuel pump 10. The fuel pump 10 has a pump piston 18, guided tightly in a cylinder 16 and driven in a reciprocating motion by a cam 20 of a camshaft of the engine, counter to the force of a restoring spring 19. In the cylinder 16, the pump piston 18 defines a pump work chamber 22, in which upon the supply stroke of the pump piston 18, fuel is compressed at high pressure. By means of a feed pump 21, fuel from a fuel tank 24 of the motor vehicle is delivered to the pump work chamber 22. A check valve 23 that opens toward the pump work chamber 22 is disposed between the feed pump 21 and the pump work chamber 22. The check valve 23 can also be omitted, in which case the communication, leading away from the cylinder 16, between the pump work chamber 22 and the fuel tank 24 is opened and closed by a control edge of the pump piston 18. A further check valve 25, opening outward from the pump work chamber 22, is disposed in the line 14. The supply line from the feed pump 21 discharges between the pump work chamber 22 and the further check valve 25.

The fuel injection valve 12 is disposed separately from the fuel pump 10 and communicates with the pump work chamber 22 via the line 14. The fuel injection valve 12 has a valve body 26, which may be embodied in multiple parts and in which an injection valve member 28 is guided longitudinally displaceably in a bore 30. The valve body 26, in its end region oriented toward the combustion chamber of the cylinder of the engine, has at least one and preferably a plurality of injection openings 32. The injection valve member 28, in its end region toward the combustion chamber, has a sealing face 34, which for instance is approximately conical, and which cooperates with a valve seat 36, embodied in the valve body 26 in its end region toward the combustion chamber; the injection openings 32 lead away from or downstream of this valve seat. In the valve body 26, between the injection valve member 28 and the bore 30, toward the valve seat 36, there is an annular chamber 38, which in its end region, remote from the valve seat 36, changes over as a result of a radial widening of the bore 30 into a pressure chamber 40 surrounding the injection valve member 28. At the level of the pressure chamber 40, as a result of a reduction in its cross section, the injection valve member 28 has a pressure shoulder 42. The end remote from the combustion chamber of the injection valve member 28 is engaged by a prestressed closing spring 44, by which the injection valve member 28 is pressed toward the valve seat 36. The closing spring 44 is disposed in a spring chamber 46 of the valve body 26 that adjoins the bore 30. The spring chamber 46 is adjoined, on its end remote from the bore 30, in the valve body 26 by a further bore 48, in which a piston 50 that is joined to the injection valve member 28 is tightly guided. The piston 50, with its face end remote from the injection valve member 28, defines a control pressure chamber 52 in the valve body 26. Embodied in the valve body 26 is a conduit 54, into which the line 14 to the fuel pump 10 discharges and which itself discharges into the pressure chamber 40.

In FIG. 1, the fuel injection apparatus is shown in a first exemplary embodiment. A communication 56 to the control pressure chamber 52 branches off from the conduit 54. The fuel injection apparatus has a first control valve 60, disposed near the fuel pump 10, that can for instance be integrated with the fuel pump 10. By means of the first control valve 60, a communication 59 of the pump work chamber 22 of the fuel pump 10 with a diversion chamber 62, embodied as a pressure reservoir, is controlled. Downstream of the check valve 25, the communication 59 branches off from the line 14. In the pressure reservoir 62, an elevated pressure is maintained, compared to the pressure in the fuel tank 24. Via a pressure limiting valve 64, the pressure reservoir 62 communicates with a relief chamber, which for instance is the fuel tank 24. By means of the pressure limiting valve 64, the pressure in the pressure reservoir 62 is kept at least nearly constant, because this valve opens when the set pressure is reached, and fuel can flow out of the pressure reservoir 62 into the fuel tank 24. If the engine has multiple cylinders, then a single common pressure reservoir 62 can be used for the fuel injection apparatuses of all the cylinders.

The first control valve 60 is electrically controllable and has an actuator 61, which can be an electromagnet or a piezoelectric actuator and is electrically triggered and by which a valve member of the control valve 60 is movable. The first control valve 60 can be embodied as either pressure-balanced or not pressure-balanced. The first control valve 60 is embodied as a 2/2-way valve, by which in a first switching position the communication 59 with the pressure reservoir 62 is opened, and in a second switching position the communication 59 with the pressure reservoir 62 is interrupted. The control valve 60 is controlled by an electric control unit 66 as a function of engine operating parameters.

For controlling the pressure in the control pressure chamber 52, a second control valve 68 is provided, by which a communication 70 of the control pressure chamber 52 with a relief chamber, such as the fuel tank 24, is controlled. The second control valve 68 is electrically controllable and has an actuator 69, which can be an electromagnet or a piezoelectric actuator and is triggered electrically and by which a valve member of the control valve 68 is movable. The second control valve 68 is preferably embodied as pressure-balanced, but it can also be not pressure-balanced. The second control valve 68 is embodied as 2/2-way valve, by which in a first switching position the communication 70 of the control pressure chamber 52 with the fuel tank 24 is opened, and by which in a second switching position the communication 70 of the control pressure chamber 52 with the fuel tank 24 is interrupted. A throttle restriction 58 is provided in the communication 59 of the control pressure chamber 52 with the conduit 54, and a further throttle restriction 71 is provided, between the control pressure chamber 52 and the second control valve 68, in the communication 70 of the control pressure chamber 52 with the fuel 24. The second control valve 68 is likewise controlled by the control unit 66. The control of the control valves 60, 68 by the control unit 66 is effected as a function of engine operating parameters, such as rpm, load and temperature.

The mode of operation of the fuel injection apparatus in accordance with the first exemplary embodiment will now be explained. In the intake stroke of the pump piston 18, fuel is pumped out of the fuel tank 24 into the pump work chamber 22 by the feed pump 21, through the opened check valve 23 or through the communication opened by the control edge of the pump piston 18. In the supply stroke of the pump piston 18, the check valve 23 closes, or the communication is covered by the pump piston 18 and the check valve 25 opens, whereupon the first control valve 60 can be opened, so that the communication 59 with the pressure reservoir 62 is opened. If the fuel injection is to begin with a preinjection, then the first control valve 60 is closed by the control unit 66, so that the communication 59 with the pressure reservoir 62 is interrupted, and high pressure can build up in the pump work chamber 22. The pressure prevailing in the pump work chamber 22 is also operative in the pressure chamber 40, via the line 14 and the conduit 54 in the valve body 26. The second control valve 68 is opened by the control unit 66, so that high pressure cannot build up in the control pressure chamber 52, despite its communication 56 with the conduit 54; instead, this pressure is now reduced to that of the fuel tank 24. By means of the throttle restrictions 58 and 71, it is attained that only a slight fuel quantity can flow out of the conduit 54 into the fuel tank 24. Once the pressure prevailing in the pressure chamber 40 has reached a level such that this pressure, via the pressure shoulder 42, exerts a force operative in the opening direction 29 on the injection valve member 28 that is greater than the force of the closing spring 44, the injection valve member 28 lifts with its sealing face 34 away from the valve seat 36, and fuel is injected through the injection openings 32 into the combustion chamber of the cylinder of the engine. The opening pressure of the fuel injection valve 12 is then dependent only on the force of the closing spring 44, because of the opened second control valve 68. The course of pressure during the injection is determined by the profile of the cam 20.

Figure 3:
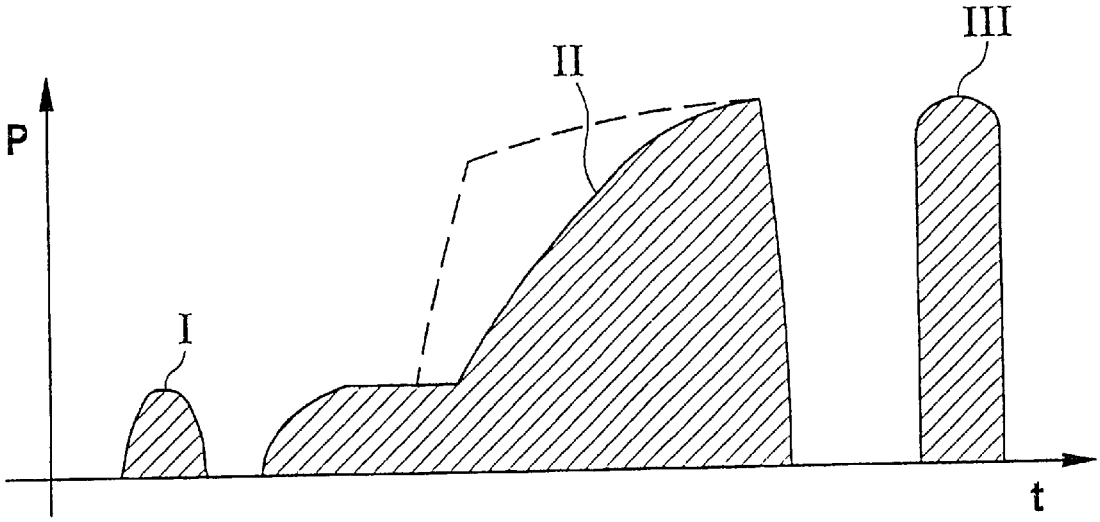
FIG. 3 shows a course of a pressure at injection openings of a fuel injection valve of the fuel injection apparatus.

Alternatively, it can also be provided that during the preinjection the first control valve 60 is opened, so that the communication 59 with the pressure reservoir 62 is opened. In that case, the pressure level at which the preinjection takes place is determined by the pressure set by means of the pressure limiting valve 64 in the pressure reservoir 62. The opening pressure of the fuel injection valve 12 is lower than the pressure set in the pressure reservoir 62 by the pressure limiting valve 64. In FIG. 3, the course of the pressure P at the injection openings 32 of the fuel injection valve 12 is shown over the time t during one injection cycle. The preinjection corresponds to the injection phase marked I in FIG. 3.

To terminate the preinjection, the second control valve 68 is closed by the control unit 66, so that the control pressure chamber 52 is disconnected from the fuel tank 24, and pressure builds up in the control pressure chamber 52 via its communication 56 with the conduit 54. As a result, via the piston 50, a force that reinforces the force of the closing spring 44 is generated on the injection valve member 28, so that the injection valve member 28 moves counter to its opening direction 29 and comes to rest with its sealing face 34 on the valve seat 36, terminating the injection.

For an ensuing main injection, the second control valve 68 is opened by the control unit 66, so that the control pressure chamber 52 is relieved again, and the fuel injection valve 12 opens. The first control valve 60 can be closed at the onset of the main injection, so that the communication 59 with the pressure reservoir 62 is interrupted, and a pressure buildup takes place in the line 14 and the pressure chamber 40 of the fuel injection valve 12, in accordance with the profile of the cam 20. Alternatively, it may also be provided that the first control valve 60 initially still remains open, so that because of the open communication 59 with the pressure reservoir 62, only a pressure corresponding to the pressure set by the pressure limiting valve 64 in the pressure reservoir 62 can build up in the line 14 and in the pressure chamber 40 of the fuel injection valve 12. The main injection then begins at a pressure level at which the preinjection has also occurred. With the first control valve 60 closed, the main injection begins at a higher pressure level than when the first control valve 60 is initially open. Next, the first control valve 60 is closed by the control unit 66, and the main injection takes place at a pressure generated in the pump work chamber 22 in accordance with the profile of the cam 20. It can also be provided that the first control valve 60 is initially closed while the second control valve 68 still remains closed, so no injection takes place yet. Then the second control valve 68 is opened only in delayed fashion, thereby delaying the onset of the main injection, and furthermore the main injection begins at a higher pressure. The main injection corresponds to an injection phase marked II in FIG. 3; the pressure course is shown in a solid line for the case where the first control valve 60 is open at the onset, and the pressure course is shown in a dashed line for the case where the first control valve 60 is already closed at the onset.

To terminate the main injection, the second control valve 68 is closed by the control unit 66, so that the control pressure chamber 52 is disconnected from the fuel tank 24, and in the control pressure chamber 52, because of its communication with the conduit 54 and thus with the pump work chamber 22, high pressure builds up, by which the fuel injection valve 12 is closed. The first control valve 60 remains closed here, so that the communication 59 with the pressure reservoir 62 is interrupted. For a postinjection, the second control valve 68 is re-opened by the control unit 66, so that the control pressure chamber 52 is relieved again and the fuel injection valve 12 opens. The postinjection takes place with a pressure course corresponding to the profile of the cam 20. Alternatively, it can be provided that for the postinjection the first control valve 60 is opened, so that the postinjection takes place only at the pressure level corresponding to the pressure reservoir 62. To terminate the postinjection, the second control valve 68 is closed by the control unit 66, and/or the first control valve 60 is opened by the control unit 66. The postinjection corresponds to an injection phase marked III in FIG. 3.

After the termination of the postinjection, the second control valve 68 can be closed or opened. The first control valve 60 is opened, so that the communication 59 with the pressure reservoir 62 is opened. In the pump work chamber 22, the pressure drops down to the pressure in the fuel tank 24, or to the pressure generated by the feed pump 21. The pump work chamber 22 is disconnected from the line 14 by the check valve 25, and in the line 14, conduit 54 and pressure chamber 40 of the fuel injection valve 12, a pressure is established in accordance with the pressure determined by the pressure limiting valve 64 in the pressure reservoir 62.

Figure 2:
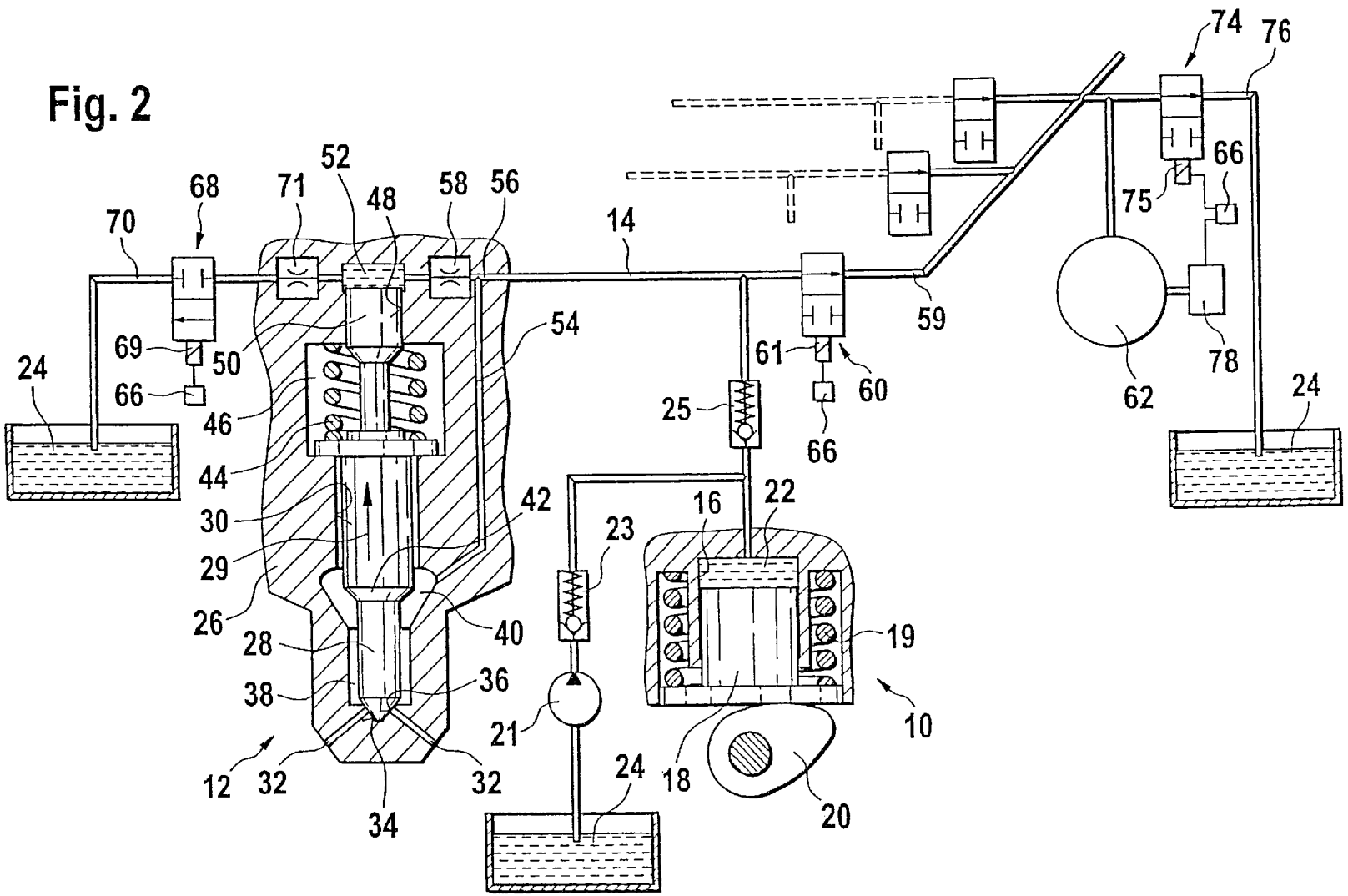
FIG. 2 shows the fuel injection apparatus in a second exemplary embodiment.

In FIG. 2, the fuel injection apparatus is shown in a second exemplary embodiment, in which the basic layout is the same as in the first exemplary embodiment described above, but the control of the pressure in the pressure reservoir 62 is modified. For controlling the pressure in the pressure reservoir 62, a third control valve 74 is provided instead of the pressure limiting valve 64. The third control valve 74 is electrically triggerable and has an actuator 75, which may be an electromagnet or a piezoelectric actuator and is electrically triggered and by which a valve member of the control valve 74 is movable. The third control valve 74 is embodied as a 2/2-way valve, and by it in a first switching position a communication 76 of the pressure reservoir 62 with the fuel tank 24, as a relief chamber, is opened, and in a second switching position the communication 76 with the fuel tank 24 is interrupted. The third control valve 74 is likewise triggered by the control unit 66. In addition, a pressure sensor 78 is provided, by which the pressure in the pressure reservoir 62 is detected and which communicates with the control unit 66. By suitable triggering of the third 74 by the control unit 66, the pressure in the pressure reservoir 62 can be variably adjusted. For instance, for the preinjection phase I and the onset of the main injection phase II, the pressure in the pressure reservoir 62 can be increased and variably adjusted as a function of engine operating parameters, so that correspondingly the pressure at which the preinjection takes place and the main injection begins is variable. The standing pressure in the line 14 and the pressure chamber 40 of the fuel injection valve 12 when the pump work chamber 22 is relieved can also be variably adjusted. Otherwise, the mode of operation of the fuel injection apparatus of the second exemplary embodiment is the same as in the first exemplary embodiment.

Figure 4:
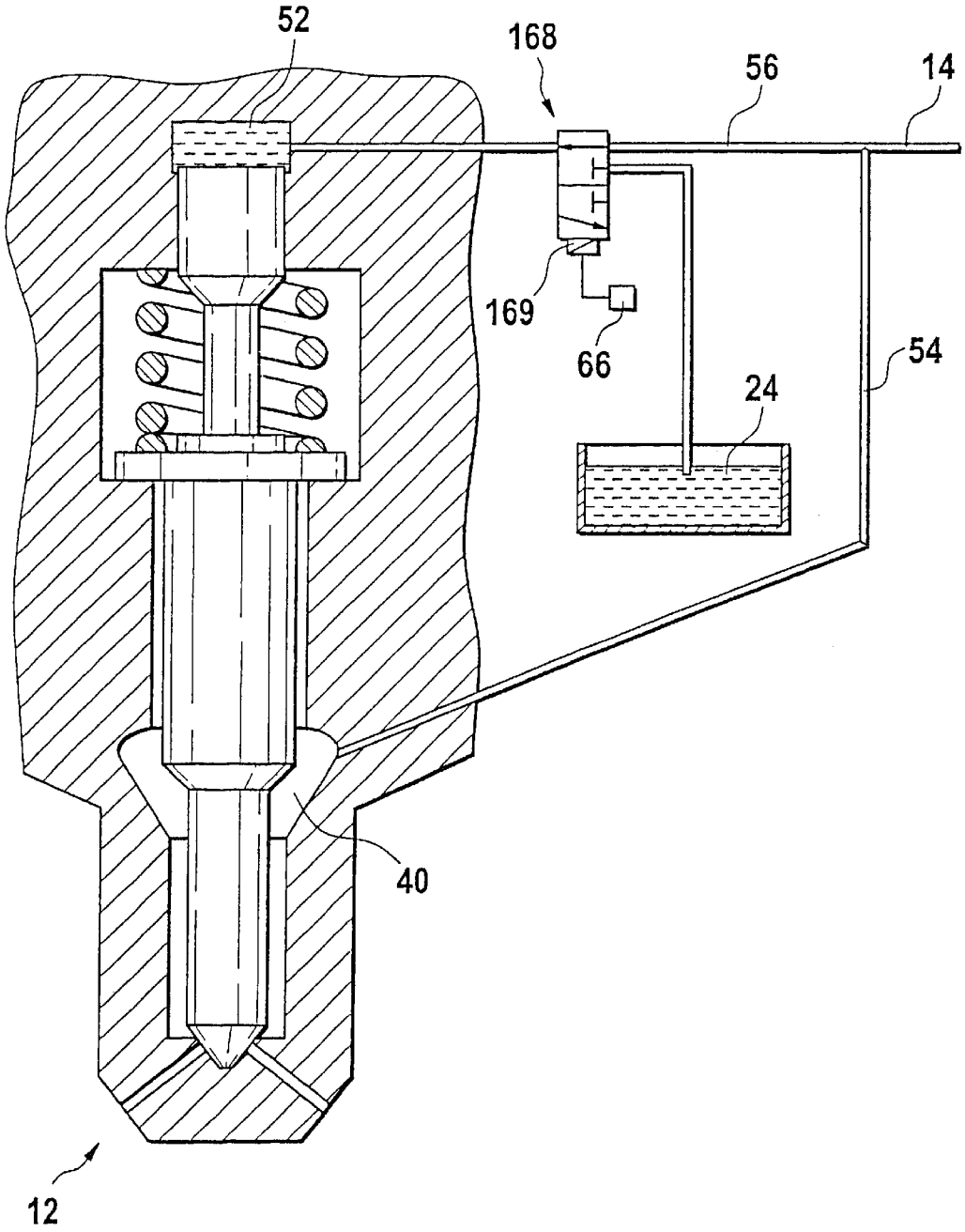
FIG. 4 is a detail of a modified version of the fuel injection apparatus.

In FIG. 4, a further version of the fuel injection apparatus is shown, in which the basic layout is essentially the same as in the first or second exemplary embodiment, but the disposition and embodiment of the second control valve 168 is modified. The second control valve 168 is electrically triggerable and has an actuator 169, which can be an electromagnet or a piezoelectric actuator, is electrically triggered, and by which a valve member of the control valve 168 is movable. The second control valve 168 is disposed in the communication 56 of the control pressure chamber 52 with the conduit 54. The second control valve 168 is embodied as a 3/2-way valve, by which in a first switching position the communication 56 of the control pressure chamber 52 with the conduit 54 and thus with the pump work chamber 22 is opened, and the control pressure chamber 52 is disconnected from the fuel tank 24, as a relief chamber. In a second switching position of the second control valve 168, the control pressure chamber 52 communicates with the fuel tank 24 as a relief chamber, and the communication 56 with the conduit 54 and thus with the pump work chamber 22 is interrupted. To enable the opening of the fuel injection valve 12, the second control valve 168 is moved by the control unit 66 into its second switching position, in which the control pressure chamber 52 is relieved into the fuel tank 24, and for closure of the fuel injection valve 12, the second control valve 168 is moved into its first switching position, in which the control pressure chamber 52 communicates with the conduit 54. Otherwise, the mode of operation of the fuel injection apparatus in this modified version is the same as in the first or second exemplary embodiment.

Figure 5:
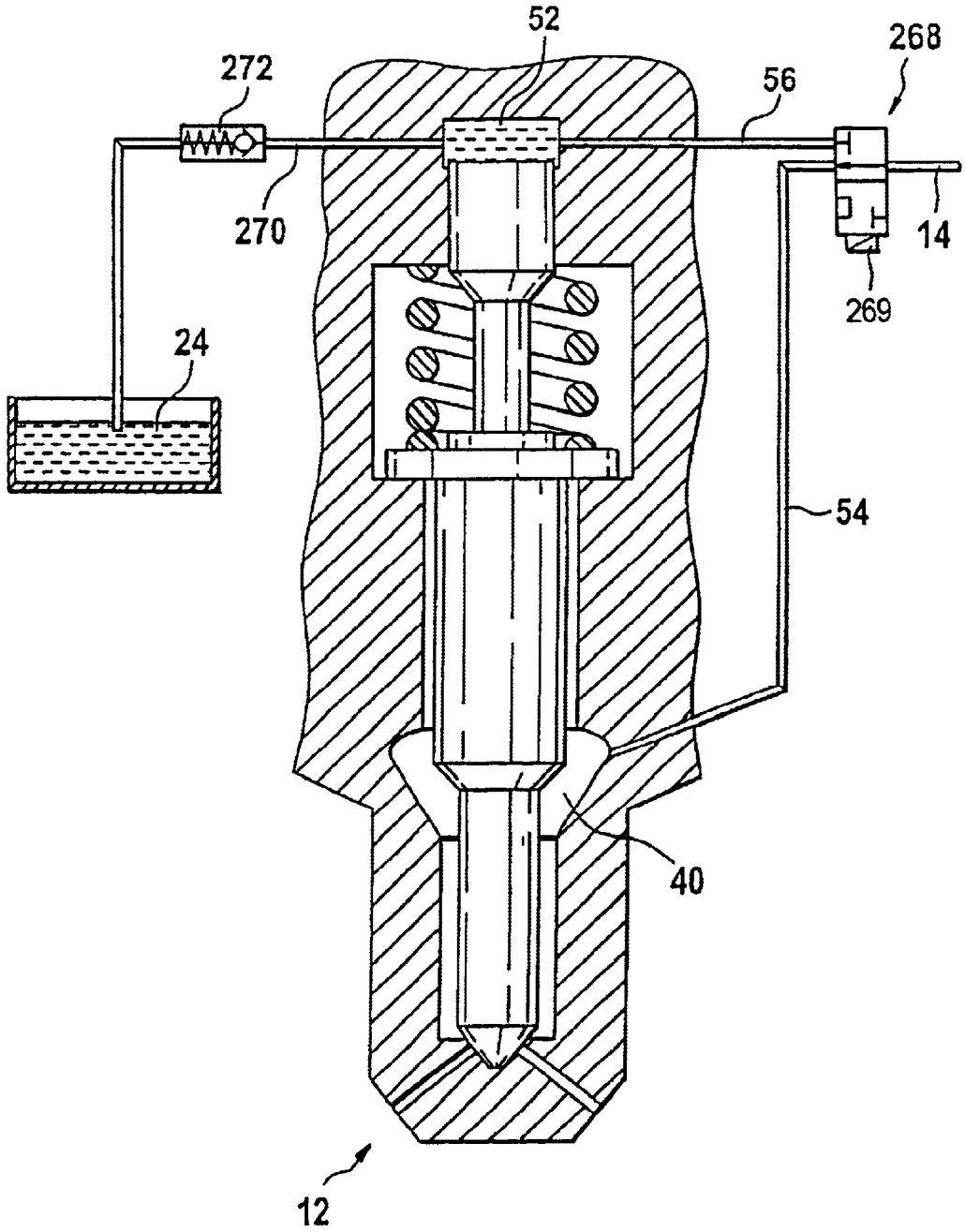
FIG. 5 is a detail of a further modified version of the fuel injection apparatus.

In FIG. 5, a further version of the fuel injection apparatus is shown, in which the basic layout is essentially the same as in the first or second exemplary embodiment, but the disposition and embodiment of the second control valve 268 is modified. The second control valve 268 is electrically triggerable and has an actuator 269, which can be an electromagnet or a piezoelectric actuator, is electrically triggered, and by which a valve member of the control valve 268 is movable. The line 14 is connected to the second control valve 268 on one side, and on the other, the conduit 54 to the pressure chamber 40 and the communication 56 to the control pressure chamber 52 are connected to it. The second control valve 268 is embodied as a 3/2-way valve, by which in a first switching position the communication 56 of the control pressure chamber 52 with the conduit 54 is opened, and the conduit 54 is disconnected from the line 14 and thus from the pump work chamber 22. In a second switching position of the second control valve 268, the control pressure chamber 52 is disconnected from the conduit 54 by this control valve, and the conduit 54 communicates with the line 14 and thus with the pump work chamber 22. The control pressure chamber 52 has a communication 270 with the fuel tank 24, as a relief chamber, in which a check valve 272 that opens toward the fuel tank 24 is disposed, and a throttle restriction (not shown) can also be provided. To enable the opening of the fuel injection valve 12, the second control valve 268 is put in its second switching position by the control unit 66, in which position the control pressure chamber 52 is disconnected from the conduit 54 and the conduit 54 communicates with the line 14, so that the pressure generated by the fuel pump 10 reaches the pressure chamber 40 of the fuel injection valve 12, and the control pressure chamber 52 is relieved into the fuel tank 24. To close the fuel injection valve 12, the second control valve 268 is put in its first switching position, in which the control pressure chamber 52 communicates with the conduit 54, but the conduit 54 is disconnected from the line 14. The pressure prevailing in the pressure chamber 40 of the fuel injection valve 12 is then operative in the control pressure chamber 52 as well, as a result of which the fuel injection valve 12 is closed. Otherwise, the mode of operation of the fuel injection apparatus in this modified version is the same as in the first or second exemplary embodiment.

The foregoing relates to preferred exemplary embodiments of the invention, it being understood that other variants and embodiments thereof are possible within the spirit and scope of the invention, the latter being defined by the appended claims.

We claim:

1. A fuel injection apparatus for internal combustion engines, the apparatus comprising one fuel pump (10) for each cylinder of the engine, which pump has a pump piston (18), driven by the engine in a reciprocating motion, that defines a pump work chamber (22) to which fuel is delivered from a fuel tank (24) and which communicates with a fuel injection valve (12) that has an injection valve member (28) by which at least one injection opening (32) is controlled and which is movable in an opening direction (29) counter to a closing force by the pressure generated in the pump work chamber (22), a first electrically controlled control valve (60), by which a communication (59) of the pump work chamber (22) with a diversion chamber (62) is controlled, and a second electrically controlled control valve (68; 168; 268), by which the pressure prevailing in a control pressure chamber (52) of the fuel injection valve (12) is controlled, by which the injection valve member (28) is urged at least indirectly in the closing direction, the diversion chamber (62) being a pressure reservoir, in which an elevated pressure, compared to the pressure prevailing in the fuel tank (24), is maintained.

2. The fuel injection apparatus according to claim 1, further comprising a pressure limiting valve (64) that opens toward the fuel tank (24) to maintain the pressure in the pressure reservoir (62) at least nearly constant.

3. The fuel injection apparatus according to claim 1, further comprising a third electrically controlled valve (74) operable to variably adjust the pressure in the pressure reservoir (62).

4. The fuel injection apparatus according to claim 3, wherein the pressure in the pressure reservoir (62) is detected by a sensor device (78), which communicates with an electric control unit (66) by which the third control valve (74) is triggered in order to adjust a predetermined pressure in the pressure reservoir (62).

5. The fuel injection apparatus according to claim 3 wherein a communication (76) of the pressure reservoir (62) with a relief chamber (24) is controlled by the third control valve (74).

6. The fuel injection apparatus according to claim 4 wherein a communication (76) of the pressure reservoir (62) with a relief chamber (24) is controlled by the third control valve (74).

7. The fuel injection apparatus according to claim 1 further comprising a check valve (23) that opens toward the pump work chamber (22) disposed in the communication of the pump work chamber (22) with the fuel tank, through which fuel is delivered to the pump work chamber (22).

8. The fuel injection apparatus according to claim 2 further comprising a check valve (23) that opens toward the pump work chamber (22) disposed in the communication of the pump work chamber (22) with the fuel tank, through which fuel is delivered to the pump work chamber (22).

9. The fuel injection apparatus according to claim 3 further comprising a check valve (23) that opens toward the pump work chamber (22) disposed in the communication of the pump work chamber (22) with the fuel tank, through which fuel is delivered to the pump work chamber (22).

10. The fuel injection apparatus according to claim 4 further comprising a check valve (23) that opens toward the pump work chamber (22) disposed in the communication of the pump work chamber (22) with the fuel tank, through which fuel is delivered to the pump work chamber (22).

11. The fuel injection apparatus according to claim 1 further comprising a check valve (25) that opens toward the first control valve (60) disposed in the communication of the pump work chamber (22) with the first control valve (60).

12. The fuel injection apparatus according to claim 2 further comprising a check valve (25) that opens toward the first control valve (60) disposed in the communication of the pump work chamber (22) with the first control valve (60).

13. The fuel injection apparatus according to claim 3 further comprising a check valve (25) that opens toward the first control valve (60) disposed in the communication of the pump work chamber (22) with the first control valve (60).

14. The fuel injection apparatus according to claim 7 further comprising a check valve (25) that opens toward the first control valve (60) disposed in the communication of the pump work chamber (22) with the first control valve (60).

15. The fuel injection apparatus according to claim 1 wherein the second control valve (168) is embodied as a 3/2-way valve, by which, in a first switching position, the control pressure chamber (52) communicates with the pump work chamber (22) and is disconnected from a relief chamber (24), and by which in a second switching position the control pressure chamber (52) communicates with the relief chamber (24) and is disconnected from the pump work chamber (22).

16. The fuel injection apparatus according to claim 7 wherein the second control valve (168) is embodied as a 3/2-way valve, by which, in a first switching position, the control pressure chamber (52) communicates with the pump work chamber (22) and is disconnected from a relief chamber (24), and by which in a second switching position the control pressure chamber (52) communicates with the relief chamber (24) and is disconnected from the pump work chamber (22).

17. The fuel injection apparatus according to claim 1 wherein the second control valve (268) is embodied as a 3/2-way valve, by which in a first switching position the control pressure chamber (52) is disconnected from a pressure chamber (40) of the fuel injection valve (12) and the pressure chamber (40) communicates with the pump work chamber (22), and by which in a second switching position the control pressure chamber (52) communicates with the pressure chamber (40) and the pressure chamber (40) is disconnected from the pump work chamber (22).

18. The fuel injection apparatus according to claim 2 wherein the second control valve (268) is embodied as a 3/2-way valve, by which in a first switching position the control pressure chamber (52) is disconnected from a pressure chamber (40) of the fuel injection valve (12) and the pressure chamber (40) communicates with the pump work chamber (22), and by which in a second switching position the control pressure chamber (52) communicates with the pressure chamber (40) and the pressure chamber (40) is disconnected from the pump work chamber (22).

19. The fuel injection apparatus according to claim 7 wherein the second control valve (268) is embodied as a 3/2-way valve, by which in a first switching position the control pressure chamber (52) is disconnected from a pressure chamber (40) of the fuel injection valve (12) and the pressure chamber (40) communicates with the pump work chamber (22), and by which in a second switching position the control pressure chamber (52) communicates with the pressure chamber (40) and the pressure chamber (40) is disconnected from the pump work chamber (22).

20. The fuel injection apparatus according to claim 17 wherein the control pressure chamber (52) has a communication (270) with a relief chamber (24), in which a check valve (272) opening toward the relief chamber (24) is preferably disposed.

* * * * *